US011795748B2

(12) United States Patent
Meusburger et al.

(10) Patent No.: US 11,795,748 B2
(45) Date of Patent: Oct. 24, 2023

(54) CONTROL CAM ASSEMBLY FOR CONTROLLING A MOVEMENT OF A FURNITURE PART

(71) Applicant: Julius Blum GmbH, Hoechst (AT)

(72) Inventors: Marc Meusburger, Egg (AT); Markus Irgang, Altach (AT); Matthias Rupp, Hohenweiler (AT)

(73) Assignee: JULIUS BLUM GMBH, Hoechst (AT)

( * ) Notice: Subject to any disclaimer, the term of this patent is extended or adjusted under 35 U.S.C. 154(b) by 118 days.

(21) Appl. No.: 17/520,066

(22) Filed: Nov. 5, 2021

(65) Prior Publication Data

US 2022/0056746 A1 Feb. 24, 2022

Related U.S. Application Data

(63) Continuation of application No. PCT/AT2020/060178, filed on May 4, 2020.

(30) Foreign Application Priority Data

May 17, 2019 (AT) ..... 50453/2019

(51) Int. Cl.
*E05F 1/10* (2006.01)
*E05D 15/58* (2006.01)
*E05F 3/20* (2006.01)

(52) U.S. Cl.
CPC ..... *E05F 1/1041* (2013.01); *E05D 15/58* (2013.01); *E05F 3/20* (2013.01); *E05D 2015/586* (2013.01); *E05Y 2900/212* (2013.01)

(58) Field of Classification Search
CPC ..... E05F 1/1041; E05F 3/20; E05D 15/58; E05Y 2900/212
See application file for complete search history.

(56) References Cited

U.S. PATENT DOCUMENTS 4,995,143 A 2/1991 Demura et al.
6,834,703 B2 12/2004 Pacholke et al.
(Continued)

FOREIGN PATENT DOCUMENTS

AU 2003204186 12/2003
CN 107002438 8/2017
(Continued)

OTHER PUBLICATIONS

Search Report dated Aug. 12, 2022 in corresponding Chinese Patent Application No. 202080036204.4, with English language translation.

(Continued)

*Primary Examiner* — Victor D Batson
*Assistant Examiner* — Matthew J Sullivan
(74) *Attorney, Agent, or Firm* — Wenderoth, Lind & Ponack, L.L.P.

(57) ABSTRACT

A control curve arrangement includes a base member having a first control curve, a switch element separate from the base member and having a second control curve, a pressure portion to be displaceably supported along the first control curve and the second control curve, and a spring device for applying a force to the pressure portion. The pressure portion, in the first operating position and in a first movement direction, is displaceable along the second control curve of the switch element. The pressure portion, in the second operating position and in a second movement direction opposite the first movement direction, is displaceable along the first control curve of the base member. A timing element is operative between the base member and the switch element, and the switch element can be transferred from the second operating position into the first operating position by the timing element in a time-delayed manner.

18 Claims, 6 Drawing Sheets

(56) References Cited

U.S. PATENT DOCUMENTS

| | | | | |
|---|---|---|---|---|
| 9,500,015 | B2 | 11/2016 | Omann et al. | |
| 10,227,806 | B2 | 3/2019 | Gabi | |
| 10,316,565 | B2 | 6/2019 | Gabl | |
| 11,274,482 | B2 * | 3/2022 | Rupp | E05D 15/58 |
| 2003/0217821 | A1 | 11/2003 | Pacholke et al. | |
| 2011/0138960 | A1 | 6/2011 | Omann et al. | |
| 2017/0241178 | A1 | 8/2017 | Gabl | |
| 2017/0247924 | A1 | 8/2017 | Gabl | |
| 2017/0260789 | A1 * | 9/2017 | Gabl | E06B 3/509 |
| 2018/0119468 | A1 | 5/2018 | Abele | |
| 2018/0298661 | A1 | 10/2018 | Salice | |
| 2019/0284859 | A1 | 9/2019 | Rupp et al. | |
| 2019/0301216 | A1 * | 10/2019 | Rupp | E05D 15/26 |
| 2019/0301218 | A1 * | 10/2019 | Rupp | E05D 15/264 |
| 2020/0018106 | A1 * | 1/2020 | Rupp | E05D 15/0634 |
| 2020/0018107 | A1 * | 1/2020 | Rupp | E05D 15/58 |
| 2020/0071980 | A1 | 3/2020 | Blum et al. | |
| 2020/0386028 | A1 * | 12/2020 | Girotto | E05F 5/003 |
| 2021/0351015 | A1 | 11/2021 | Abe et al. | |

FOREIGN PATENT DOCUMENTS

| | | |
|---|---|---|
| JP | 2-18081 | 2/1990 |
| JP | 2009-89809 | 4/2009 |
| JP | 2018-502234 | 1/2018 |
| JP | 2020-63462 | 4/2020 |
| TW | 201917268 | 5/2019 |
| WO | 2018/0129572 | 7/2018 |
| WO | 2018/136983 | 8/2018 |

OTHER PUBLICATIONS

International Search Report dated Jul. 27, 2020 in International (PCT) Application No. PCT/AT2020/060178.

* cited by examiner

CONTROL CAM ASSEMBLY FOR CONTROLLING A MOVEMENT OF A FURNITURE PART

BACKGROUND OF THE INVENTION

The present invention relates to a control curve arrangement for controlling a movement of a furniture part movably-supported relative to a furniture carcass. The control curve arrangement includes a base member having a first control curve, and a switch element separate from the base member, the switch element having a second control curve. The base member and the switch element are movably-supported relative to one another between a first operating position and at least a second operating position. A pressure portion is configured to be displaceably supported along the first control curve and the second control curve, and a spring device applies a force to the pressure portion. The pressure portion, in the first operating position and in a first movement direction, is configured to be displaceable, at least over a region, along the second control curve of the switch element. The pressure portion, in the second operating position and in a second movement direction opposite the first movement direction, is configured to be displaceable along the first control curve of the base member.

Moreover, the invention relates to a furniture drive and a guide system for guiding at least one furniture part movably-supported relative to a furniture carcass, the furniture drive and the guide system comprising a control curve arrangement of the type to be described.

Further, the invention relates to an item of furniture comprising a furniture drive or a guide system of the type to be described.

In the field of furniture fittings, furniture drives have been known for many years by which an unlocking of the movable furniture part (drawer, furniture flap or a door wing) from the furniture carcass can be provided by manually applying a pressure force to the movable furniture part so as to subsequently eject the movable furniture part into an open position. For this purpose, such furniture drives include a so-called Touch-Latch mechanism. With such a mechanism, the closing movement of the movable furniture part and the direction of movement in order to unlock the movable furniture part extend in the same direction, namely in the closing direction. Upon a normal, smooth closing operation (which can be implemented manually or by a spring-assisted retraction device), the movable furniture part is safely held in the closed position by a locking device at the end of the closing movement. However, when the movable furniture part is moved with an undue high speed in the closing direction, the movable furniture part is moved until reaching a rear end stop (corresponds to an overpressing position). As result, the locking device is triggered and the movable furniture part is immediately ejected back into an open position.

WO 2018/129572 A1 discloses a guide system for guiding two door wings hingedly connected to one another. The two door wings, in a parallel position to one another, can be inserted into a lateral insertion compartment of the furniture carcass. In FIG. 5*a*, a control curve is fixed to a sidewall of the furniture carcass and a switch separate from the control curve is provided, the switch having a setting contour. Upon an insertion movement of the door wings into the lateral insertion compartment, a pressure roller pressurized by a spring device is movable along the control curve fixed to the furniture carcass. Upon an extending movement of the door wings, starting from an end position located within the insertion compartment, the pressure roller, in contrast, is moved along the setting contour of the switch. Therefore, the pressure roller (and therewith the movable furniture part) is capable to bypass a wave trough of the stationary control curve. As a result, the pressure roller can be moved into an extended position without an abrupt decrease of the spring force. In the rear region of the insertion compartment, an ejection device is provided (FIGS. 7*a*, 7*b*). By the ejection device, the door wings can be ejected into an open position by manually applying a force to the door wings in a direction of an overpressing position lying behind the closed position. Here, there is also the problem that the ejection device will inadvertently be triggered, caused by an undue high closing speed of the door wings, and the door wings will immediately be ejected back in a direction of an open position.

SUMMARY OF THE INVENTION

It is an object of the present invention to propose a control curve arrangement mentioned in the introductory part, thereby avoiding the above-discussed drawbacks.

According to the invention, at least one timing element is provided, the at least one timing element being operative between the base member and the switch element. The switch element is configured to be transferred at least from the second operating position into the first operating position by the at least one timing element in a time-delayed manner.

In other words, the control curve arrangement includes at least one timing element operative between the base member and the switch element. The timing element is configured to position the base member and the switch element relative to one another such, after the insertion movement of the pressure portion into an end position corresponding to a closed position of the movable furniture part in a mounted condition, that an outward movement of the pressure portion can be prevented in the opposite direction. Only after a period of time specified by the timing element, the base member and the control curve are again positioned to one another such that a movement of the pressure portion into an extended position can be made possible.

The pressure portion can be configured, for example, as a displaceable pressure roller. Preferably, the pressure portion is arranged on a pivotally-supported lever. The spring device can engage on the pivotally-supported lever. The spring device can include at least one helical spring, preferably at least one tension spring.

According to an embodiment, the spring device is configured to be tensioned by a movement of the pressure portion along the second control curve of the switch element.

The switch element can be pivotally supported about a pivoting axis. According to an embodiment, the switch element can be configured as a two-armed lever. It can be preferably provided that the two-armed lever includes two lever ends having different lengths.

For example, the timing element can be configured as a, preferably hydraulic, linear damper or as a, preferably hydraulic, rotational damper. The linear damper includes a piston-cylinder-unit configured to be operative between the base member and the switch element. Thereby, the cylinder of the linear damper is arranged on the base member, and a piston rod connected to the piston engages the switch element. Of course, also the reverse arrangement is possible, in which the cylinder of the linear damper is arranged on the switch element and the piston rod engages the base member.

In the case where a rotational damper is used as the timing element, the rotational damper can be arranged on a pivoting axis of the switch element, and a pivoting movement of the switch element can be decelerated by a rotational damper in a time-delayed manner.

Also, embodiments are conceivable in which a pneumatic valve or an electronic timing element can be utilized.

According to an embodiment of the invention, the pressure portion is movably supported between a first position corresponding to an open position of the furniture part, and a second position corresponding to a closed position of the furniture part, and the switch element is arranged in a region adjacent to the second position. In other words, the switch element is arranged near the closed position of the movable furniture part in such a case.

The furniture drive for moving at least one furniture part movably-supported relative to a furniture carcass includes at least one control curve arrangement of the described type.

The guide system according to the invention for guiding at least one furniture part movably-supported relative to a furniture carcass includes the combination of the following features:

- a first guide rail having a longitudinal direction for guiding the at least one movable furniture part,
- at least one second guide rail for guiding the at least one movable furniture part, the second guide rail extending transversely to the longitudinal direction of the first guide rail in a mounted condition,
- a carrier for moving the at least one movable furniture part, in the mounted condition, in the direction extending transversely to the longitudinal direction of the first guide rail along the second rail between an extended and a retracted position, and
- a furniture drive of the aforementioned type, wherein the carrier is configured to be driven by the furniture drive from the extended position at least over a region in a direction of the retracted position and/or that the carrier is configured to be driven by the furniture drive from the retracted position at least over a region in a direction of the extended position.

The item of furniture according to the invention includes a furniture drive or a guide system of the aforementioned type.

BRIEF DESCRIPTION OF THE DRAWINGS

Further details and advantages of the present invention result from the following description of figures.

DETAILED DESCRIPTION OF THE INVENTION

Figure 1A:
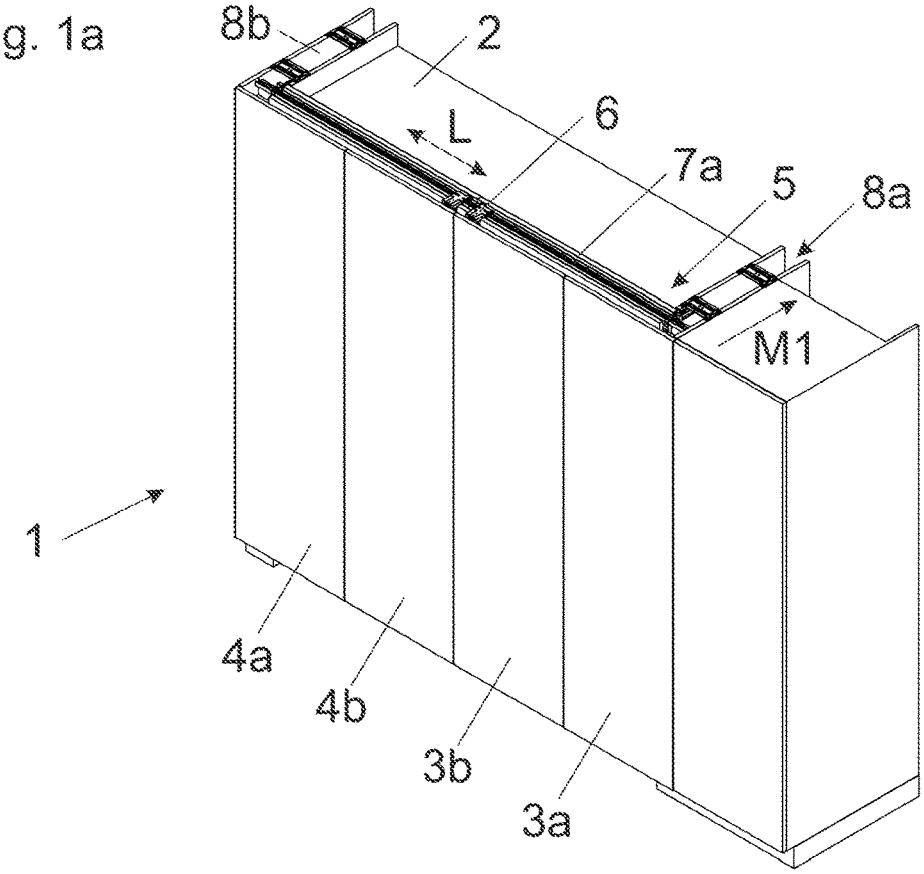
FIG. 1*a*, 1*b* are perspective views of an item of furniture comprising a furniture carcass and furniture parts movable relative thereto.

FIG. 1*a* shows a perspective view of an item of furniture 1 comprising a furniture carcass 2 and panel-shaped furniture parts 3*a*, 3*b*; 4*a*, 4*b* configured to be movable relative to the furniture carcass 2. The furniture parts 3*a*, 3*b*, 4*a*, 4*b* are movably supported by a guide system 5 between a first position, in which the furniture parts 3*a*, 3*b*, 4*a*, 4*b* are aligned substantially coplanar to one another, and a second position, in which the furniture parts 3*a*, 3*b*, 4*a*, 4*b* are aligned substantially parallel to one another. The furniture parts 3*a*, 3*b*, in the second (parallel) position, can be inserted in a first movement direction (M1) into a lateral receiving compartment 8*a* of the furniture carcass 2, whereas the two other furniture parts 4*a*, 4*b*, in a parallel position to one another, can be inserted into a further receiving compartment 8*b*. The functionality will be explained in the following with the aid of the furniture parts 3*a* and 3*b*, and the same explanations apply to the other furniture parts 4*a*, 4*b*. The guide system 5 includes a first guide rail 7*a* having a longitudinal direction (L), and a guide carriage 6 configured to be connected to the second furniture part 3*b* is displaceably supported along the first guide rail 7*a*.

Figure 1B:
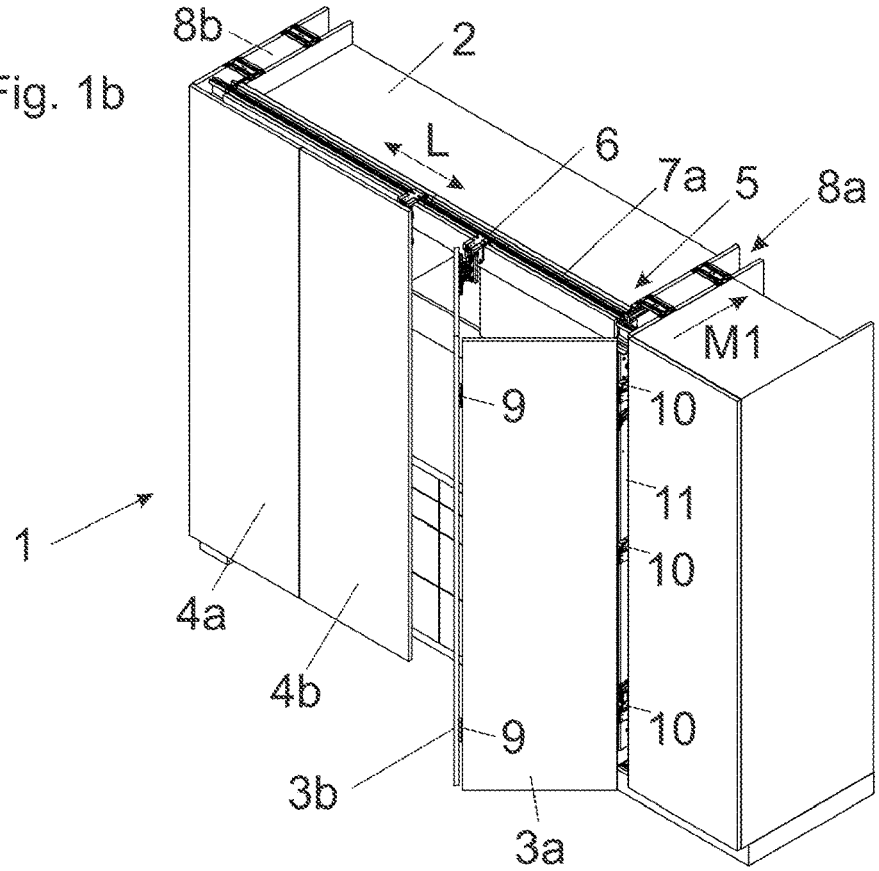

FIG. 1*b* shows the item of furniture 1, in which the furniture parts 3*a*, 3*b* have been moved from the coplanar position shown in FIG. 1*a* into an angled position to one another. The first furniture part 3*a* is supported on a carrier 11 via two or more furniture hinges 10. The carrier 11 is configured to be inserted in the first movement direction (M1), that is to say in a direction of the depth of the furniture carcass 2, into the lateral receiving compartment 8*a*. In the shown figure, the carrier 11 is located in a transfer position in which the carrier 11 adjoins the first guide rail 7*a* in the longitudinal direction (L) such that the guide carriage 6 can be transferred to and from between the first guide rail 7*a* and the carrier 11. In the shown transfer position, the carrier 11 is releasably locked to the first guide rail 7*a*, and the locking between the first guide rail 7*a* and the carrier 11 can be unlocked by an entry of the guide carriage 6 in or onto the carrier 11. The carrier 11 is in the form of a longitudinal column, and a length of the carrier 11 corresponds to at least half of a height of the furniture parts 3*a*, 3*b*. The two furniture parts 3*a*, 3*b* are hingedly connected to one another about a vertically extending axis via at least one hinge fitting 9. The second furniture part 3*b* is displaceably supported along the first guide rail 7*a* via the guide carriage 6.

Figure 2A:
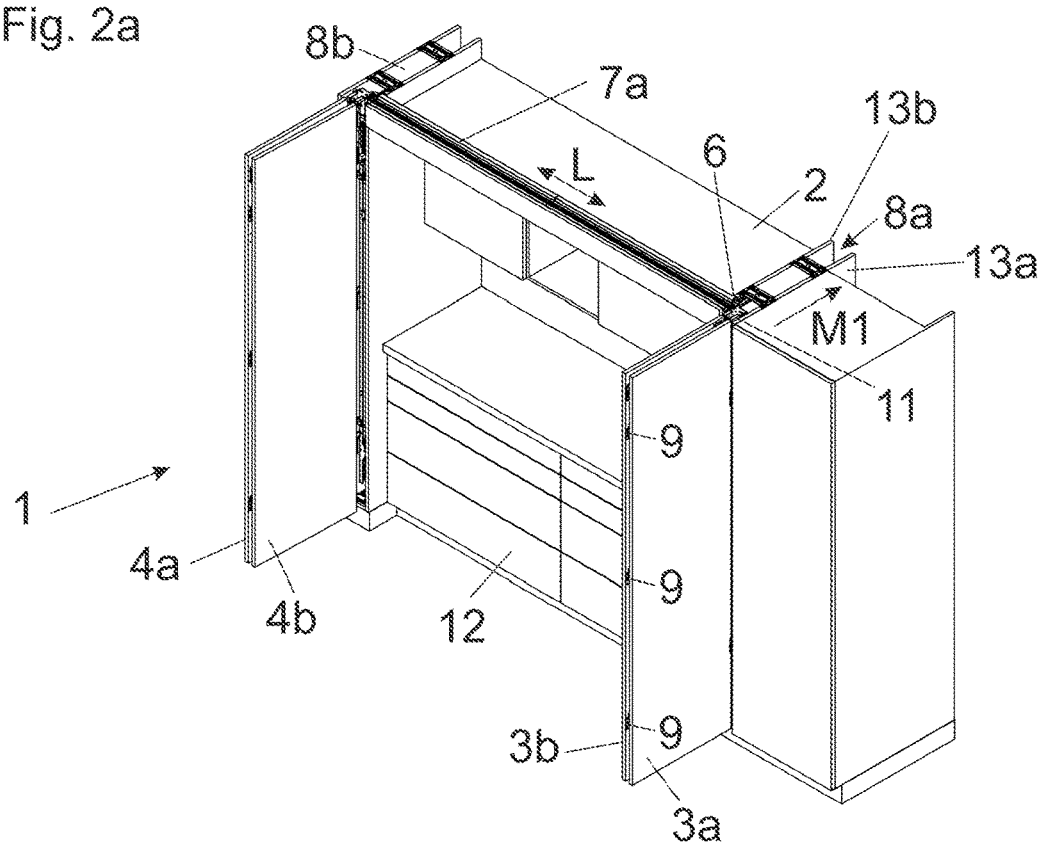
FIG. 2*a*, 2*b* show the item of furniture according to FIGS. 1*a*, 1*a* in further positions of the furniture parts to one another.

FIG. 2*a* shows the item of furniture 1 with the furniture parts 3*a*, 3*b* which are now aligned parallel to one another. The carrier 11 has been unlocked from the first guide rail 7*a* by an entry of the guide carriage 6, Therefore, the carrier 11 (jointly with the guide carriage 6 and the furniture parts 3*a*, 3*b*) can be inserted in the first direction of movement (M1) along a second guide rail 7*b* (FIG. 3) into the receiving compartment 8*a*, the second guide rail 7*b* extending transversely to the longitudinal direction (L) of the first guide rail 7*a*.

Figure 2B:
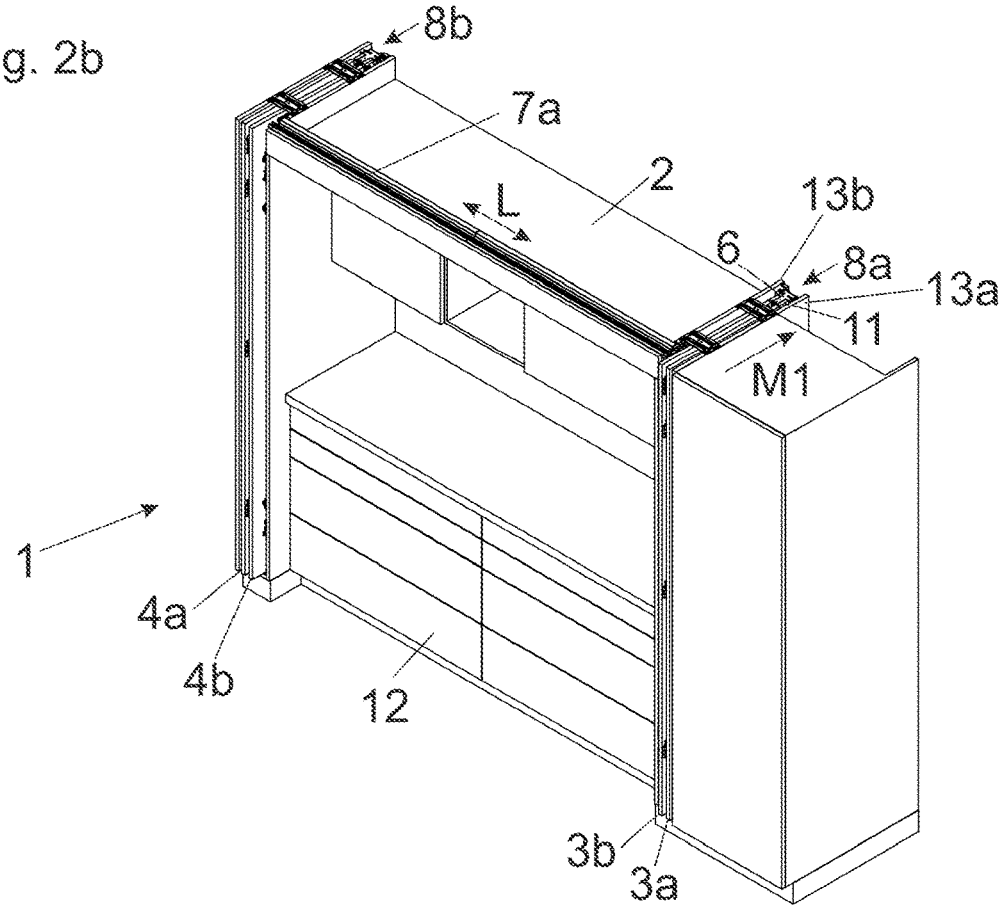

FIG. 2*b* shows the item of furniture 1 with the furniture parts 3*a*, 3*b* which are now located in a fully inserted condition within the receiving compartment 8*a*. The furniture parts 3*a*, 3*b* are thus movably supported by the guide system 5 from the first position according to FIG. 1*a*, in which the furniture parts 3*a*, 3*b* are aligned substantially coplanar to one another, and a second position according to FIG. 2*b*, in which the furniture parts 3*a*, 3*b* are aligned substantially parallel to one another and can be received within the receiving compartment 8*a*. In this way, for example, a kitchen 12 as shown in FIG. 2*a*, 2*b* can be entirely covered so as to visually separate the kitchen 12 from a remaining area of a living room. In the shown embodiment, the receiving compartment 8*a* is formed by a sidewall 13*b* and a partition wall 13*a* spaced from the sidewall 13*b* in a parallel relationship. The furniture parts 3*a*, 3*b*, in a parallel position to one another, can be inserted in a first movement direction (M1) between the sidewall 13*b* and the partition wall 13*a*.

Figure 3:
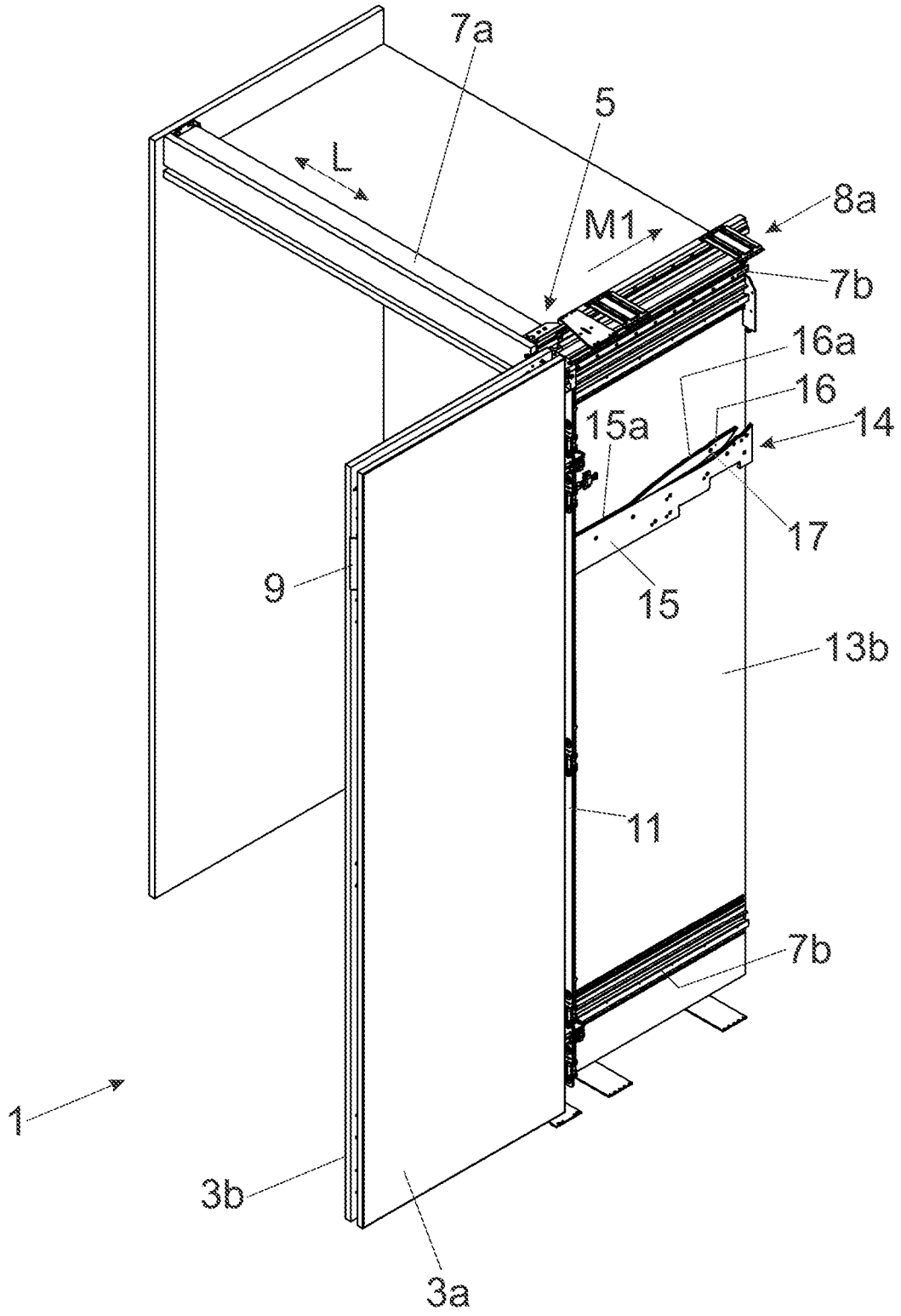
FIG. 3 shows the item of furniture with the control curve arrangement for controlling a movement of the furniture part, the control curve arrangement being fixed to the sidewall.

FIG. 3 shows the item of furniture 1, in which the partition wall 13*a* is hidden for the sake of improved overview, thereby permitting an insight into the lateral receiving compartment 8*a*. At least one second guide rail 7*b* for guiding the furniture parts 3*a*, 3*b* is fixed to the sidewall 13*b*, the second guide rail 7*b* extending transversely, preferably at a right angle, to the longitudinal direction (L) of the first guide rail 7*a*. In the shown embodiment, two second guide rails 7*b* are provided which are mutually spaced from one another in a height direction of the item of furniture 1. A control curve arrangement 14 for controlling a movement of the furniture parts 3*a*, 3*b* is arranged on the sidewall 13*b*. The control curve arrangement 14 includes a base member 15 having a first control curve 15*a*, and a switch element 16 separate from the base member 15, the switch element 16 having a second control curve 16*a*. In the shown embodiment, the switch element 16 is pivotally supported about a pivoting axis 17. It can be preferably provided that the switch element 16 is configured as a two-armed lever pivotable about the pivoting axis 17, the lever including lever arms having different lengths.

FIG. 4*a*-4*f* show a possible embodiment of a control curve arrangement 14 for controlling a movement of the furniture parts 3*a*, 3*b* in the first movement direction (M1). The control curve arrangement 14 includes the base member 15 to be fixed to the sidewall 13*b*, the base member 15 having the first control curve 15*a*. The control curve arrangement 14 further includes the movable switch element 16 having the second control curve 16*a*. Preferably, the switch element 16 is pivotable about the pivoting axis 17. A lever 19 is pivotally supported on the carrier 11, and a pressure portion 20, preferably in the form of a rotationally supported pressure roller 20*a*, is arranged on the lever 19. A spring device 18 is provided for applying a force to the pressure portion 20, and the pressure portion 20 can be pressed against the control curves 15*a*, 16*a* by a force of the spring device 18. In the shown embodiment, the spring device 18 includes at least one helical spring, preferably at least one tension spring. A first end of the spring is fixed to the carrier 11 and a second end of the spring is fixed to the lever 19.

Figure 4A:
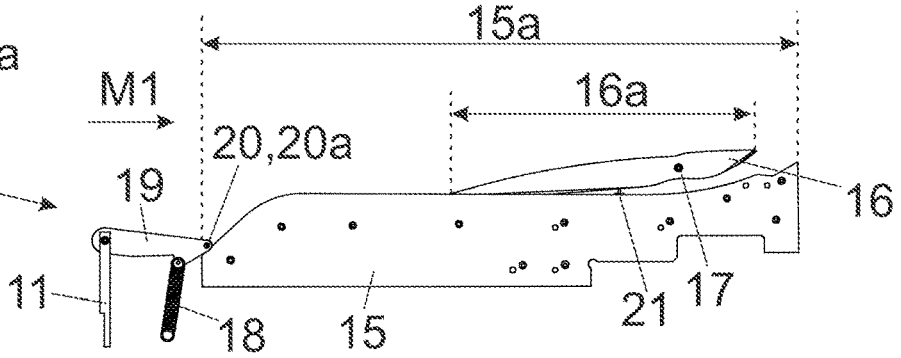
FIG. 4*a*-4*f* show a possible embodiment of a control curve arrangement in side views, in which a movement of the pressure portion in a first movement direction is depicted in temporal sequences.

In FIG. 4*a*, the pressure portion 20 is located on a first (front) end region of the first control curve 15*a* of the base member 15. This position corresponds to an extended position of the furniture parts 3*a*, 3*b* (see FIG. 3). In FIG. 4*a*, the switch element 16 is located in a first operating position, and at least one timing element 21 is configured to be operative between the base member 15 and the switch element 16. When now the furniture parts 3*a*, 3*b* are moved from the position shown in FIG. 3 in a first movement direction (M1), the pressure portion 20 is also displaced along an ascending partial section of the first control curve 15*a*, thereby tensioning the spring device 18.

Figure 4B:
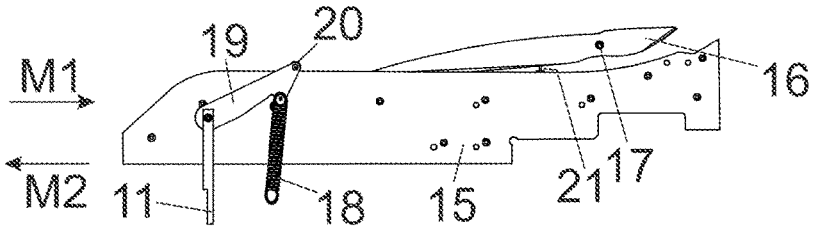

When the furniture parts 3*a*, 3*b* are further moved in the first movement direction (M1), the pressure portion 20 reaches a flat-shaped partial section of the first control curve 15*a* of the base member 15, as shown in FIG. 4*b*. The furniture parts 3*a*, 3*b* are thus neither accelerated in the first movement direction (M1) nor accelerated in a second movement direction (M2) opposite the first movement direction (M1).

Figure 4C:
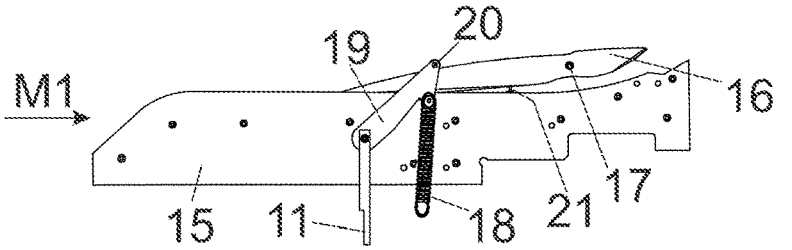

Upon a continued movement in the first movement direction (M1) according to FIG. 4*c*, the pressure portion 20 is moved along the second control curve 16*a* of the switch element 16. By the ascending partial section of the second control curve 16*a*, the spring device 18 can be further tensioned.

Figure 4D:
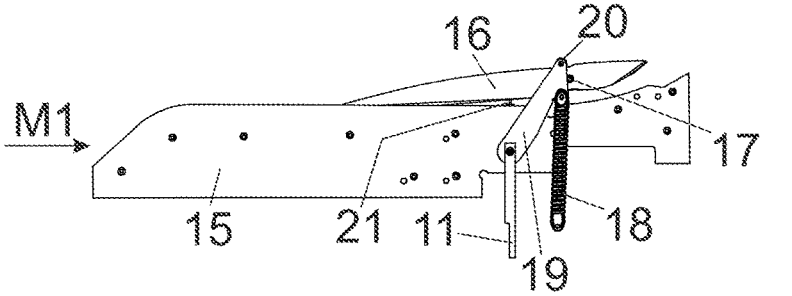

In FIG. 4*d*, the pressure portion 20 has reached the region of the pivoting axis 17 of the switch element 16, and the tensioning operation of the spring device 17 is practically terminated.

Figure 4E:
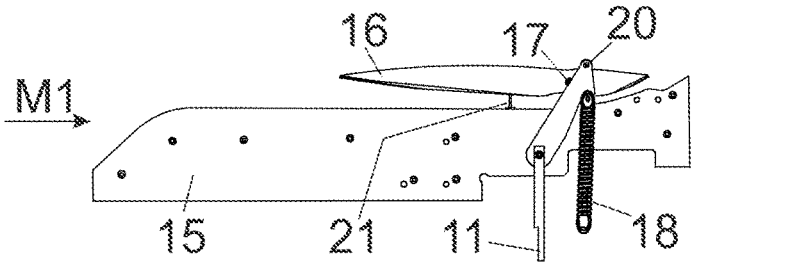
Figure 4F:
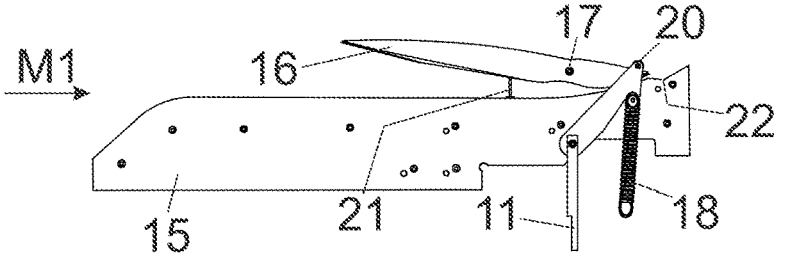

In FIG. 4*e*, the pressure portion 20 has left behind the pivoting axis 17 of the switch element 16, and the switch element 16 is tilted, by a force of the tensioned spring device 18, about the pivoting axis 17 into a second operating position. The timing element 21 operative between the base member 15 and the switch element 16, is thereby moved in a second operating position. By the descending partial section of the second control curve 16*a* of the switch element 16, the pressure portion 20 (and therewith the furniture parts 3*a*, 3*b*) can be retracted in the first movement direction (M1) by a force of the relaxing spring device 18, as shown in FIG. 4*f*. The first control curve 15*a* of the base member 15 includes at least one locking recess 22 for releasably locking the pressure portion 20. Therefore, the pressure portion 20 (and therewith the furniture parts 3*a*, 3*b*) are held in position with a predetermined force in a closed position.

Figure 5A:
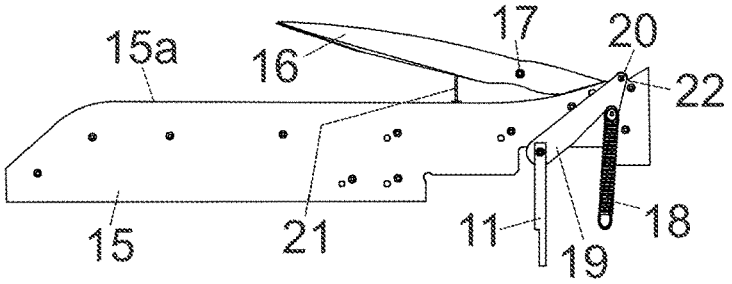
FIG. 5*a*-5*f* show the control curve arrangement according to FIGS. 4*a*-4*f*, in which a movement of the furniture parts in a second movement direction is only possible after expiry of a certain period of time.

FIG. 5*a* shows the pressure portion 20 which is releasably locked to the locking recess 22 of the first control curve 15*a*. The switch element 16 is located in the second operating position, and the timing element 21 operative between the base member 15 and the switch element 16 now comes into effect. The switch element 16 is configured as a two-armed lever, the lever including two lever ends having different lengths. The switch element 16, due to the larger weight of the longer lever arm, is pivoted in a counterclockwise direction. By the timing element 21, this movement of the switch element 16 occurs in a time-delayed manner and lasts, for example, approximately two seconds.

Figure 5B:
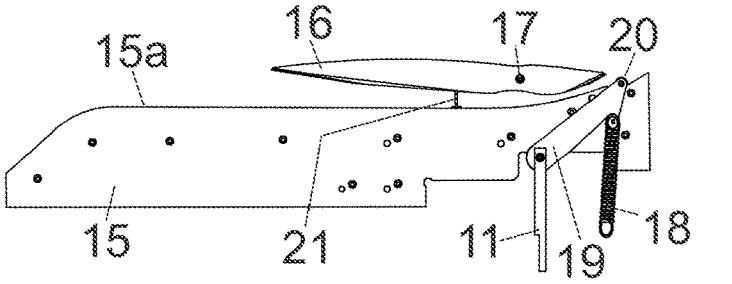
Figure 5C:
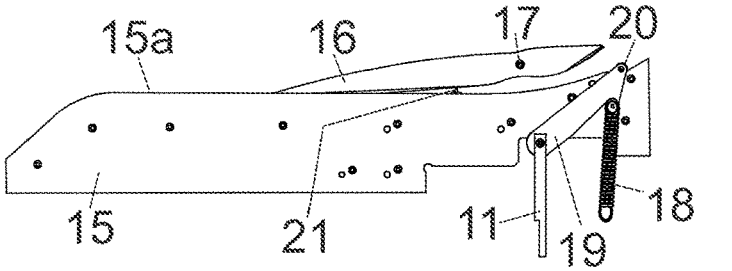

In FIG. 5*b*, the switch element 16, due to the larger weight of the longer lever arm of the switch element 16, is further pivoted in the counterclockwise direction. The movement of the switch element 16, from the second operating position shown in FIG. 5*a* into the first operating position shown in FIG. 5*c*, occurs in a time-delayed manner by virtue of the timing element 21. This has the purpose that the pressure portion 20, when having an undue high speed in the first movement direction (M1), will not be immediately ejected in a second movement direction (M2) opposing the first movement direction (M1). The pressure portion 20 would then, with a position of the switch element 16 according to FIG. 5*a*, run onto the steeply positioned shorter lever arm of the switch element 16. However, the shorter lever arm of the switch element 16 is held in the steep position by the pressure portion 20 pressurized by the spring device 18. Therefore, the pressure portion 20 cannot reach the region adjacent to the pivoting axis 17 of the switch element 16, and a tilting movement of the switch element 16 about the pivoting axis 17 can be prevented thereby. The carrier 11 can only be moved again in the second movement direction (M2), opposite the first movement direction (M1), when the switch element 16 has again adopted the first operating position shown in FIG. 5*c*.

Figure 5D:
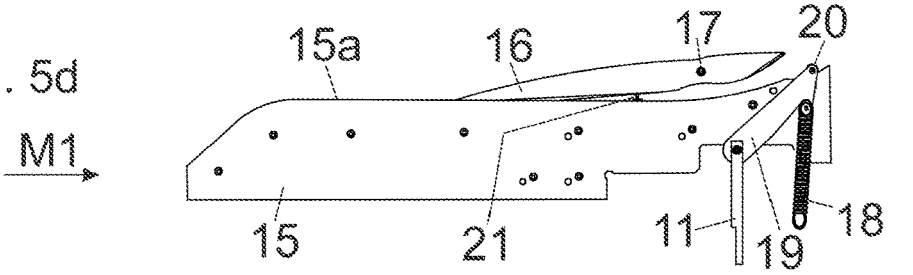
Figure 5E:
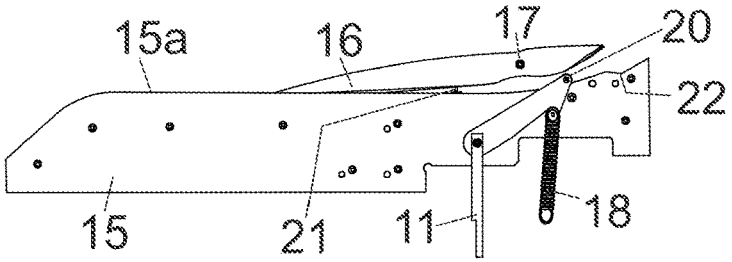

When now the carrier 11 is moved, from a position in which the pressure portion 20 is locked to the locking recess 22, into an overpressing position (FIG. 5*d*) by manually applying a force to the carrier 11 in the first movement direction (M1), the pressure portion 20 is moved upwardly along a steeply ascending partial section of the first control curve 15*a*. When the manual application of force to the carrier 11 is removed, the pressure portion 20 in the form of the pressure roller 20*a* can be again moved back in the second movement direction (M2). Usually, there is so much momentum available that the pressure portion 20 runs over the locking recess 22 and is further movable in the second movement direction (M2), that is to say in a direction of an extended position of the carrier 11. Accordingly, an ejection device separate from the control curve arrangement 14 for ejecting the carrier 11 in the second movement direction (M2) is not mandatorily required. However, such an ejection device may, of course, be provided if needed. The ejection device can be configured to be triggered by overpressing the carrier 11, when the pressure portion 20 is locked to the locking recess 22. By the ejection device, the carrier 11 can be subsequently ejected in the second movement direction (M2) at least over a region.

Figure 5F:
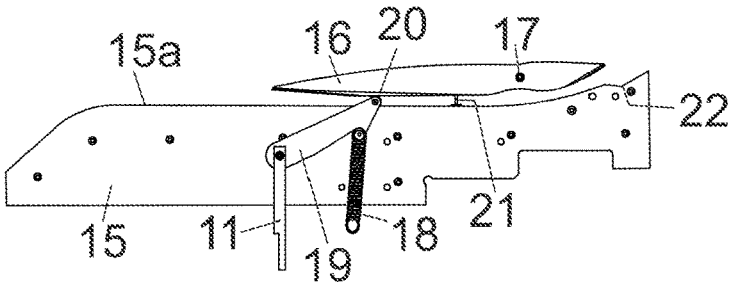

Upon a further extension movement of the carrier 11 in the second movement direction (M2), an acceleration of the carrier 11 can be provided, due to the descending section of the first control curve 15*a*. Subsequently, the pressure portion 20 can be displaced along the flat partial section of the first control curve 15*a* (FIG. 5*f*). At the end of the ejection movement, the carrier 11 is significantly accelerated in the second movement direction (M2) by the steeply ascending partial section of the first control curve 15*a*.

Figure 6A:
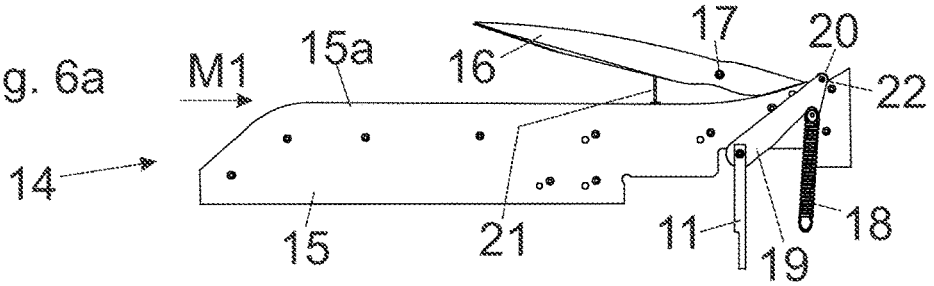
FIG. 6*a*-6*d* show a position of the switch element, in which a movement of the pressure portion in the second movement direction is prevented, and two perspective views of the control curve arrangement in the first operating position and in the second operating position of the switch element.
Figure 6B:
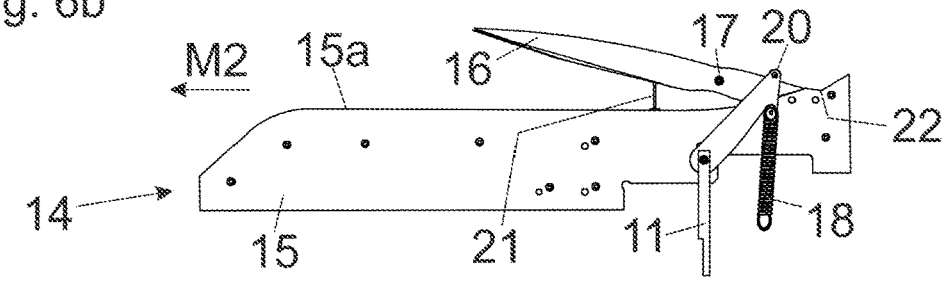

FIG. 6*a* and FIG. 6*b* show the case in which the furniture parts 3*a*, 3*b* (and therewith the pressure portion 20) have been moved with an undue high speed in the first movement direction (M1). As shown in FIG. 6*b*, it can be seen that the switch element 16 is located in the second operating position and, therefore, a movement of the pressure portion 20 in the second movement direction (M2) is blocked. The switch element 16 is held for a short time in the second operating position by the timing element 21. In the second operating position, the shorter lever arm of the switch element 16 is held in a steep position by a force of the spring device 18. Therefore, a movement of the pressure portion 20 until reaching the pivoting axis 17 of the switch element 16 is not possible. Only after the time-delayed movement of the switch element 16 until reaching the first operating position has been terminated (FIG. 5*c*), a movement of the carrier 11 in the second movement direction (M2) can be again unblocked.

Figure 6C:
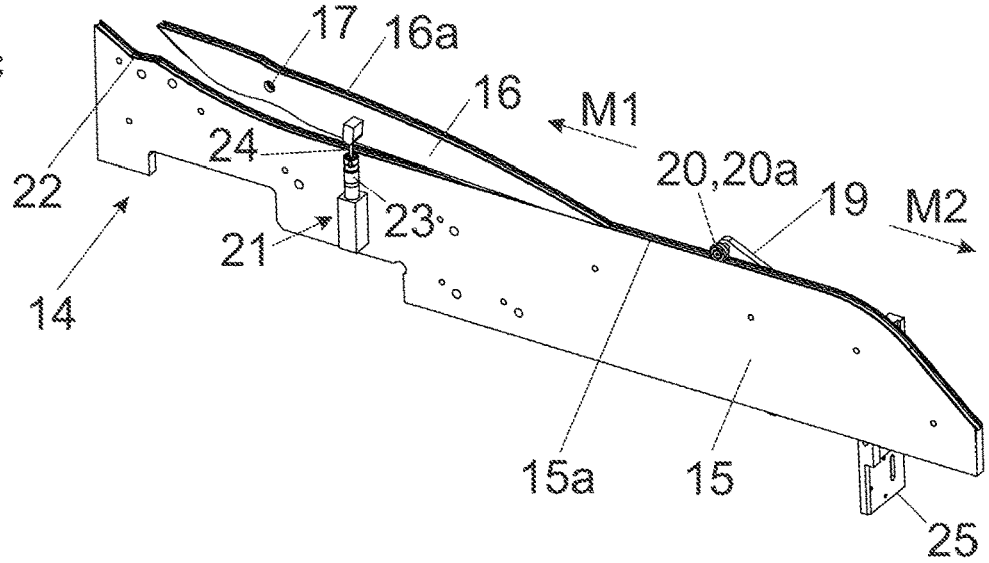

FIG. 6*c* shows the control curve arrangement 14 with the base member 15, the control curve 15*a* arranged on the base member 15, the switch element 16 and the second control curve 16*a* arranged on the switch element 16. The lever 19 with the pressure portion 20 is arranged on a mounting portion 25, the mounting portion 25 being connected or being configured to be connected to the carrier 11. Upon a movement of the carrier 11 in the first movement direction (M1), the pressure portion 20 in the form of the pressure roller 20*a* is configured to run along the first control curve 15*a* of the base member 15 and along the second control curve 16*a* of the switch element 16.

The switch element 16 is movably supported, preferably pivotally supported about the pivoting axis 17. In FIG. 6*c*, the switch element 16 is in the first operating position so as to allow the pressure portion 20 to run onto the second control curve 16*a* of the switch element 16 in the first movement direction (M1). At least one timing element 21 is operative between the base member 15 and the switch element 16. In the shown embodiment, the timing element 21 includes a, preferably hydraulic, linear damper having a cylinder 23 and a piston rod 24 displaceable relative to the cylinder 23. The cylinder 23 is fixed to the base member 15 and the piston rod 24 is fixed to the switch element 16. Likewise, the cylinder 23 could be fixed to the switch element 16 and the piston rod 24 could be fixed to the base member 15. Instead of the timing element 21 in the form of a linear damper, a, preferably hydraulic, rotational damper may also be provided. For example, the rotational damper can be supported on the pivoting axis 17 and can be configured to dampen a movement of the switch element 16 from the second operating position (FIG. 6*d*) into the first operating position (FIG. 6*c*) in a time-delayed manner. The rotational damper can also have a freewheel-function, in which a movement of the rotational damper in a first rotational direction occurs in an undampened manner and a movement in a second rotational direction occurs in a dampened manner.

Figure 6D:
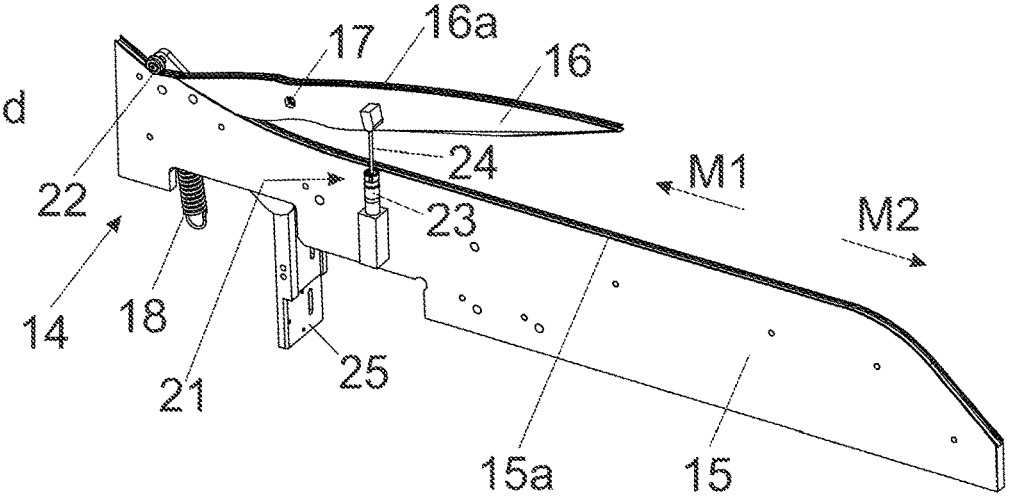

FIG. 6*d* shows the control curve arrangement 14 in the second operating position of the switch element 16, and a movement of the switch element 16 from the second operating position into the first operating position (FIG. 6*c*) can be dampened by the timing element 21. Due to the larger weight of the longer lever arm of the switch element 16, the switch element 16 is movable from the second operating position (FIG. 6*d*) into the first operating position (FIG. 6*c*).

The invention claimed is:

1. A control curve arrangement for controlling a movement of a furniture part movably-supported relative to a furniture carcass, the control curve arrangement comprising:

a base member having a first control curve, a switch element separate from the base member, the switch element having a second control curve, wherein the base member and the switch element are movably-supported relative to one another between a first operating position and a second operating position, a pressure portion configured to be displaceably supported along the first control curve and the second control curve, and a spring device for applying a force to the pressure portion, wherein the pressure portion, in the first operating position and in a first movement direction, is configured to be displaceable along the second control curve of the switch element, and wherein the pressure portion, in the second operating position and in a second movement direction opposite the first movement direction, is configured to be displaceable along the first control curve of the base member, wherein a timing element is operative between the base member and the switch element, wherein the switch element is configured to be transferred from the second operating position into the first operating position by the timing element in a time-delayed manner.

2. The control curve arrangement according to claim 1, wherein the pressure portion is a displaceable pressure roller.

3. The control curve arrangement according to claim 1, wherein the pressure portion is arranged on a pivotally supported lever.

4. The control curve arrangement according to claim 1, wherein the spring device includes a helical spring.

5. The control curve arrangement according to claim 1, wherein the spring device is configured to be tensioned upon a movement of the pressure portion along the second control curve of the switch element.

6. The control curve arrangement according to claim 1, wherein the switch element is pivotally supported about a pivoting axis.

7. The control curve arrangement according to claim 1, wherein the switch element is a two-armed lever.

8. The control curve arrangement according to claim 1, wherein the timing element is a linear damper or a rotational damper.

9. The control curve arrangement according to claim 1, wherein the pressure portion is movably supported between a first position corresponding to an open position of the furniture parts, and a second position corresponding to a closed position of the furniture parts, wherein the switch element is arranged in a region adjacent to the second position.

10. The control curve arrangement according to claim 1, wherein the first control curve of the base member includes a locking recess for releasably locking the pressure portion.

11. A furniture drive for moving a furniture part movably-supported relative to a furniture carcass, the furniture drive comprising the control curve arrangement according to claim 1.

12. A guide system for guiding a furniture part movably-supported relative to a furniture carcass, the guide system comprising:

a first guide rail having a longitudinal direction for guiding the movable furniture part, a second guide rail for guiding the movable furniture part, the second guide rail extending transversely to the longitudinal direction of the first guide rail in a mounted condition, a carrier for moving the movable furniture part, in the mounted condition, in the direction extending transversely to the longitudinal direction of the first guide rail along the second rail between an extended and a retracted position, and the furniture drive according to claim 11, wherein the carrier is configured to be driven by the furniture drive from the extended position in a direction of the retracted position and/or the carrier is configured to be driven by the furniture drive from the retracted position in a direction of the extended position.

13. An item of furniture comprising the guide system according to claim 12.

14. The item of furniture according to claim 13, wherein the item of furniture comprises a furniture carcass and at least two furniture parts movably-supported relative to the furniture carcass, wherein the at least two furniture parts are hingedly connected to one another via a vertically extending axis in the mounted position, and the at least two furniture parts are movable by the guide system between a first position, in which the at least two furniture parts are aligned substantially parallel to one another, and a second position, in which the at least two furniture parts are aligned substantially coplanar to one another.

15. The item of furniture according to claim 14, wherein the furniture carcass includes a receiving compartment for receiving the at least two furniture parts in the first position, in which the at least two furniture parts are aligned substantially parallel to one another.

16. The control curve arrangement according to claim 4, wherein the helical spring is a tension spring.

17. The control curve arrangement according to claim 7, wherein the switch element includes two lever arms having different lengths.

18. The control curve arrangement according to claim 8, wherein the timing element is a hydraulic linear damper or a hydraulic rotational damper.

* * * * *